US007735571B2

(12) United States Patent
Fabre

(10) Patent No.: US 7,735,571 B2
(45) Date of Patent: Jun. 15, 2010

(54) DEVICE FOR EXTINGUISHING FIRE BY INJECTION OF A GAS GENERATED BY THE COMBUSTION OF A PYROTECHNIC BLOCK

(75) Inventor: Christian Fabre, Tournefeuille (FR)

(73) Assignee: Airbus France, Toulouse (FR)

( * ) Notice: Subject to any disclaimer, the term of this patent is extended or adjusted under 35 U.S.C. 154(b) by 547 days.

(21) Appl. No.: 11/132,395

(22) Filed: May 19, 2005

(65) Prior Publication Data

US 2005/0257937 A1 Nov. 24, 2005

(30) Foreign Application Priority Data

May 19, 2004 (FR) ..... 04 50997

(51) Int. Cl.
*A62C 2/00* (2006.01)
*A62C 13/76* (2006.01)

(52) U.S. Cl. ..... 169/46; 169/28; 169/89

(58) Field of Classification Search ..... 169/46, 169/56, 57, 59–61, 6–8, 12, 28, 75, 85, 42, 169/26, 89; 60/253, 204, 229; 417/392, 417/393, 379

See application file for complete search history.

(56) References Cited

U.S. PATENT DOCUMENTS 3,701,256 A * 10/1972 Pelham et al. ..... 60/39.47
4,877,051 A 10/1989 Day
5,609,210 A 3/1997 Galbraith et al.
5,611,566 A * 3/1997 Simon et al. ..... 280/736
6,257,341 B1 7/2001 Bennett
6,601,653 B2 * 8/2003 Grabow et al. ..... 169/16
2002/0070035 A1 6/2002 Grabow et al.
2005/0150663 A1 7/2005 Fabre et al.

FOREIGN PATENT DOCUMENTS

GB 2 028 127 A 3/1980
WO WO 93/15793 8/1993
WO WO 93/25950 12/1993
WO WO 98/02211 1/1998

OTHER PUBLICATIONS

Comercial Notice: "El-Flow Thermal Mass Flow Meters and Controllers for Gases", Bronkhorst High-Tech B. V., 26 pages.
Comercial Notice: "Paddle-Wheel Flow Sensor/Switch for Easy On/Off Control" Burkert, 2 pages.
U.S. Appl. No. 11/720,665, filed Jun. 1, 2007, Fabre.

* cited by examiner

*Primary Examiner*—Davis Hwu
(74) *Attorney, Agent, or Firm*—Oblon, Spivak, McClelland, Maier & Neustadt, L.L.P.

(57) ABSTRACT

Extinction device with a generator of gas through combustion of a pyrotechnic block connected to means of distributing said generated gas in the fire zone. The device further comprises means of regulating the pressure generated in order to impose an oxygen concentration profile in the fire zone. Said regulation means may for example be a controlled valve or arise from the lay out of the pyrotechnic generator.

The device is particularly suited to aircraft engine fires since it does not use halogenated fire extinguishing agents.

31 Claims, 4 Drawing Sheets

DEVICE FOR EXTINGUISHING FIRE BY INJECTION OF A GAS GENERATED BY THE COMBUSTION OF A PYROTECHNIC BLOCK

TECHNICAL FIELD

The invention concerns fire fighting devices, otherwise known as extinguishers. In particular, the invention finds its application in fixed installation fire extinguishing devices that may be remotely triggered.

More particularly, the invention concerns the generation of an inert gas by combustion of a pyrotechnic composition and the diffusion of said gas in the fire zone with a controlled flow rate; the invention concerns an extinguisher comprising a combustion enclosure, a regulation system and means of diffusion in the fire zone, in particular used in the aeronautics field.

STATE OF THE PRIOR ART

Usually, extinguishing devices comprise a reservoir containing an extinguishing agent that is diffused into the fire zone in order to extinguish it, but also to prevent its extension.

Agent reservoir extinguishers are classified into two major categories. The first category concerns permanent pressure devices in which a gas assures the permanent pressurisation of the agent within a unique cylinder serving as a reservoir for said agent. The extinguishing agent is released by a valve, at the outlet of said cylinder. In the second category, a propellant gas is only released when the extinguisher is brought into service and propels the extinguishing agent, which is therefore not stocked under pressure.

By way of illustration, as an extinguisher of the first type, one may consider the extinguishers presently used to extinguish aircraft engine fires. These devices use halon as extinguishing agent, stored in liquid form due to the level of pressurisation of the cylinder used as reservoir. Depending on the safety requirements, two extinguishers or more may be installed. One or several distribution pipes connected to each cylinder allows the distribution of the agent towards the zone(s) to be protected. At the lower end of the cylinder, a calibrated port makes it possible to seal the distribution pipe in order to maintain the halon in the cylinder. A pressure sensor is also installed in order to verify, in a continuous manner, the pressurisation of the cylinder. When a fire is detected, a pyrotechnic detonator is triggered: the shock wave generated by said detonator pierces the frangible disc, which leads to the emptying of the cylinder and the release of the extinguishing agent under the effect of pressure towards the zones to be protected via distribution pipes.

As regards the extinguishers of the second category, they use a separate pressurisation device. These fire fighting devices are generally equipped with a first reservoir of compressed gas and a second reservoir for the extinguishing agent. When the device is used, the gas contained in the first reservoir is brought into communication through the intermediary of a port with the second reservoir, which allows the pressurisation of the cylinder containing the extinguishing agent. Sometimes, the first reservoir of compressed gas is replaced by a gas generator as described in the document WO 98/02211. In all cases, when the extinguishing agent is pressurised, it is ejected from the extinguishers of the second category to combat the fire, like the devices of the first category.

The disadvantage of these extinguishers, whatever the category considered, is the continuous storage of the extinguishing agent, with the necessary operations of surveillance and verification, such as periodic weighing. For the devices used for extinguishing fires onboard aircraft, belonging to the first category, are added the necessities linked to the pressurised storage of the extinguishing agent and, in particular, the problems caused by their sensitivity to micro leaks.

DESCRIPTION OF THE INVENTION

The aim of the invention is to overcome the cited disadvantages of the extinguishers, particularly for fires in aircraft engines, among other advantages.

To achieve this aim, the invention concerns as for one of its aspects a fire extinguishing device in which the extinguishing agent is an inert gas uniquely produced when necessary, in other words at the moment the extinguisher is used, by the combustion of a pyrotechnic material chosen in a suitable manner. One may thus generate a large quantity of inert gas, the composition of which depends on the nature of the pyrotechnic material; in particular, the gas may comprise more than 20% of nitrogen or more than 20%, or even 40%, of a mixture of inert gases such as nitrogen, carbon monoxide and/or carbon dioxide. Preferably, the inert gas generated will be composed essentially of nitrogen given its relative facility of production by pyrotechnic combustion.

The nitrogen generated is injected into the zones where the fire has been detected. In order to assure a reliable extinction, the inert gas is driven from the extinguishing device according to a regulated pressure, in order to be able in particular to convey the quantity of oxygen in the fire zones to follow a predetermined profile as a function of time, for example a virtually constant concentration level during a non zero time lapse.

The device according to the invention therefore comprises a pyrotechnic generator of gas combined with means of distributing said generated gas as extinguishing agent and means for regulating the pressure therein.

Advantageously, the gas generator comprises an enclosure comprising a block of propellant and a pyrotechnic igniter. The ignition of the pyrotechnic igniter by electrical current allows, for example, the initiation of the combustion of the propellant, the decomposition of which enables the generation of an inert gas.

Preferably, the extinction device comprises filters located in the combustion enclosure or in the distribution means, so that the soot and ashes also produced by the combustion of the pyrotechnic composition do not reach the fire zone.

Advantageously, the device comprises means of cooling the generated gas.

The extinction device may comprise a variable number of gas generators, which are connected to the same distribution means. It is moreover possible to have several pyrotechnic materials of different composition in a same enclosure.

The regulation means are configured in a preliminary manner by the determination of the pressure at which the inert gas is expulsed from the enclosure, directly linked to the flow rate of the gas ejected onto the fire zone and to the concentration, in oxygen or other component, sought in the zones to be treated. Depending on the geometry of the distribution network, the dimensions and the ventilation of the zones to be treated, while taking account of the head losses or the layout of the zones to be treated, those skilled in the art can determine the required pressure. Such calculations may be refined by experiments.

According to one embodiment, the pressure regulation means consist of at least one control valve located in the distribution means, the opening of which is controlled during the sequence of triggering the extinguisher, or by an external order, or by the pressurisation of the combustion enclosure. The control valve is advantageously controlled according to a given law and defined by the user, if necessary using information from sensors, which measure for example the concentration in oxygen in the zones to be treated; this enables an even finer regulation in closed loop of the gas pressure.

The opening of the valve may be controlled remotely, controlled by manual control, or controlled by a control mechanism coupled to means of igniting the pyrotechnic composition.

The geometry of the block of pyrotechnic material may also generate combustion gases according to a predetermined law. The regulation means may thus, additionally or alternatively, consist in a determination of the different parameters of the gas generator, and in particular the geometry of the block of propellant, which assures a controlled generation of inert gas injected into the zones to be protected.

In this case, it is possible to replace the control valve by a calibrated port: once triggered, the combustion of the block of pyrotechnic material no longer requires control and the calibrated port makes it possible to control the pressure at which the combustion of the propellant takes place in such a way as to assure the flow of agent necessary to place the fire zone under inert gas.

The regulation may also, alternatively or in addition, be assured by other regulation components such as a pressure reducing valve combined or not with a device that creates a pressure difference (diaphragm, nozzle).

Whatever the regulation means, they make it possible to optimise the time during which the concentration in inert agent leads for example to a level of oxygen less than 12% in the fire zones considered. In this way, it is also possible to create concentration slots of variable shape and to precisely control the time and the level of protection of the zone considered.

As or for one aspect of the invention, the extinguisher may be remotely triggered by an operator. It may also be brought into operation directly by an ignition device that receives information from a sensor that detects the conditions linked to the probability of a fire. In order to avoid undesired triggering, in particular during maintenance operations, the device may be equipped with neutralisation means.

The extinction device according to the invention is preferably used in aircraft, more particularly in turbojet engines where it makes it possible to do away with the halogenated extinguishing agents used at present.

BRIEF DESCRIPTION OF DRAWINGS

The appended figures and drawings will enable the invention to be better understood, but are only given by way of indication and are in nowise limitative.

DETAILED DESCRIPTION OF SPECIFIC EMBODIMENTS

Figure 1:
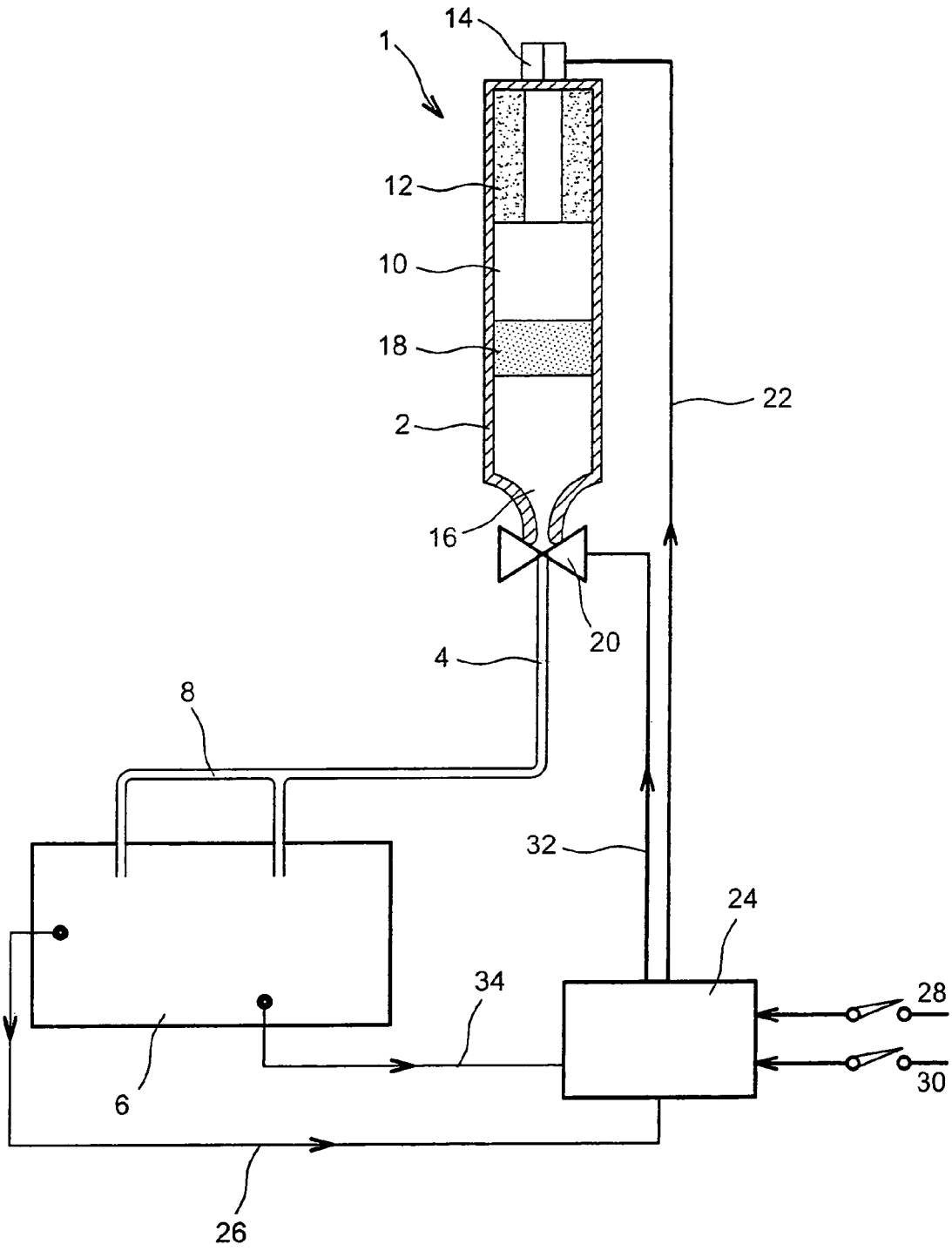
FIG. 1 represents an extinction device conforming to one of the embodiments of the invention.

As shown in FIG. 1, the extinction device or extinguisher 1, comprises an inert gas generator 2 combined with means of distributing the gas 4. The means of distributing the gas 4 may consist in a pipe sufficiently long to reach the fire zone 6, or be coupled to any known distribution device 8, such as for example a multiple outlet pipe.

The gas generator 2 consists of a combustion chamber 10, for example cylindrical, in which is placed a pyrotechnic cartridge 12, composed in general of propellant. The combustion of the propellant, initiated by the ignition device 14, generates an inert gas that flows in the distribution means 4 via an outlet port 16.

The inert gas, composed to a large extent of nitrogen and/or carbon oxide, produced by the decomposition through combustion of pyrotechnic compositions, is at high temperature, and a rapid cooling may be necessary, before introduction into the fire zones. Means of cooling may thus also be provided for, for example an "active" filter, in other words a chemical compound introduced into or to the exterior of the combustion chamber 10 and absorbing a part of the heat of combustion, or a metal filter. Moreover, it may be desirable that filters, chemical and/or mechanical, are present in order to filter the soot.

These different filters 18 may be located upstream and/or downstream of the gas outlet port 16, in the enclosure 10 or in the distribution means 4.

Advantageously, the outlet port 16 of the combustion chamber 10 may be sealed by a closing device 20, in order to isolate the propellant from the exterior environment as long as its action is not sought. In particular, the closing device 20 may be a tared disc, in other words a membrane that breaks or opens after the ignition as soon as the pressure within the combustion chamber 10 reaches a certain threshold.

The pressure within the enclosure 10 is advantageously atmospheric pressure when the extinction device 1 is not used. As soon as the ignition device 14 is triggered, the block of propellant 12 begins to burn and to generate a pressure in the enclosure 10. The ignition device 14 may consist in any known device. It may be triggered manually, by direct action on the device 14.

Preferably, the ignition device 14 is remotely triggered through the intermediary of a control line 22, which may be coupled to a control unit 24. Advantageously, a signal 26 coming from a fire detector may be used as an automatic triggering device through the intermediary of the control unit 24. In this case of automatic triggering, it may be preferable to provide for a device 28 for neutralising the control means 22. It may also be useful to provide for a manual triggering device 30 on the control unit 24 and/or the ignition device 14.

In order to extinguish the fire, one restricts the input of oxygen in the fire zone 6. To this end, the gas generated by the combustion of the pyrotechnic block 12 and ejected by the distribution device 8 enables a reduction in the relative concentration of oxygen. It is desirable that the generated gas is inert, but also that it is not polluting or corrosive, particularly in the case of a fire zone 6 located in an aircraft engine. In this respect, the generated gas thus comprises a percentage of nitrogen, at least 20% or even 40%, obtained by the combustion of a highly "nitrogenated" pyrotechnic composition; it is also possible to associate the nitrogen for example with carbon dioxide in order to increase the concentration in injected inert gas and attain the desired thresholds.

It is generally accepted, for example, that, below a concentration in oxygen of 12%, no fire can survive. It is possible to determine the quantity of gas that must be injected into the fire zone 6 in order to attain this level of $O_2$; in the case of ventilation of the fire zones, the air renewal rate is taken into account in calculating the quantity of gas to be injected. This makes it possible to determine the quantity of pyrotechnic product 12 to be placed in the extinguisher considered.

In order to optimise the extinction capabilities, a system for regulating the flow of gas at the output of the pipe 8 in the fire zone 6 is provided for in an extinguisher 1 according to the invention, in other words means of regulating the pressure existing in the distribution means 4. Thanks to such a pressure control, it is possible to minimise the quantity of pyrotechnic material 12 and/or the size of the enclosure 10 while at the same time assuring that the fires are put out. For example, the pressure regulating means make it possible to obtain a predetermined profile of the concentration in oxygen in the fire zone, such as a plateau during a non zero time lapse, or a profile in slots; it is clear that each of the concentrations may have an error margin compared to the theoretical fixed value of the plateau. Thus, a plateau may be a "flattened Gaussian", or a curve between two values separated by less than 10% of the value of the plateau.

According to a preferred embodiment, the device for sealing 20 the gas generator 2 may thus be a control valve, advantageously remotely controlled by first control means 32. Such control valves are known for example from WO 93/25950 or U.S. Pat. No. 4,877,051 and are commercially available.

The first control means 32 may be a control line coming from a control unit 24, advantageously merged with that used to trigger the ignition device 14. The information entered in the control unit 24 makes it possible to modify, either manually or automatically, according to a predetermined sequence or as a function of the measured parameters, the degree of opening and/or sealing of the valve 20.

Thus for example, it is possible to provide for a sensor that measures the concentration in oxygen in the fire zone 6: through the control line 34, the unit 24 can modify the signal sent by the first control means 32 to regulate the opening of the valve 20.

Figure 2:
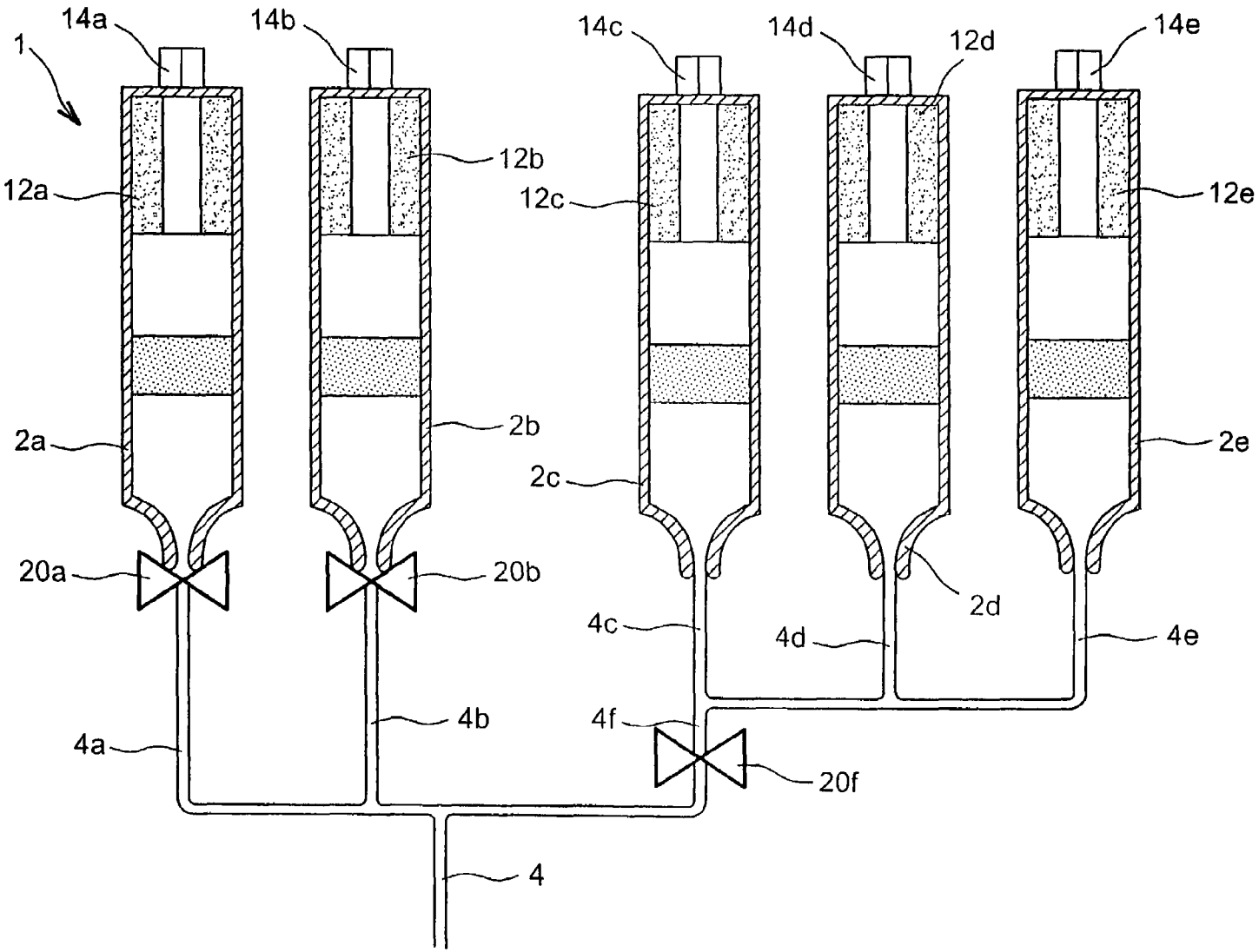
FIG. 2 shows an alternative to the extinction device according to the invention.

Extinction devices 1 according to the invention may be placed in parallel and for example connected to a same distribution device 8. Another embodiment, shown in FIG. 2, concerns the presence of several generators 2*a*-2*e* of inert gas within the same extinction device 1. The blocks of pyrotechnic material 12*a*-12*e* of each of said generators may be of a similar or different nature (composition, geometry, as will be explained below). The ignition devices 14*a*-14*e* for each of the generators 2*a*-2*e* may be triggered independently or simultaneously. Advantageously, control means make it possible to selectively trigger the combustion and thus to optimise the number of generators 2*a*-2*e* used according to the fire detection and fire parameters, or to choose the most appropriate generator if the nature of the blocks of propellant 12 is different.

In this embodiment, it is possible that each gas generator 2*a*, 2*b* is placed in communication with the distribution means 4 via its own pipe 4*a*, 4*b* equipped with its regulation valve 20*a*, 20*b*. It is also possible to provide for a single valve 20*f* located on a pipe 4*f* leading to the generators 2*c*, 2*d*, 2*e* coupled between each other by the intermediary of pipes 4*c*, 4*d*, 4*e*. In the same way as for the embodiment shown in FIG. 1, the regulation may be carried out in open or closed loop.

Another possibility for achieving the regulation of the pressure according to the invention is to calibrate the block of pyrotechnic material in order to generate a pressure in the enclosure 10 conforming to a defined profile. Said pressure P (stagnation pressure) is transmitted directly, and in a configured and controlled manner, to the distribution means 4 and thus to the fire zone 6.

Figure 3:
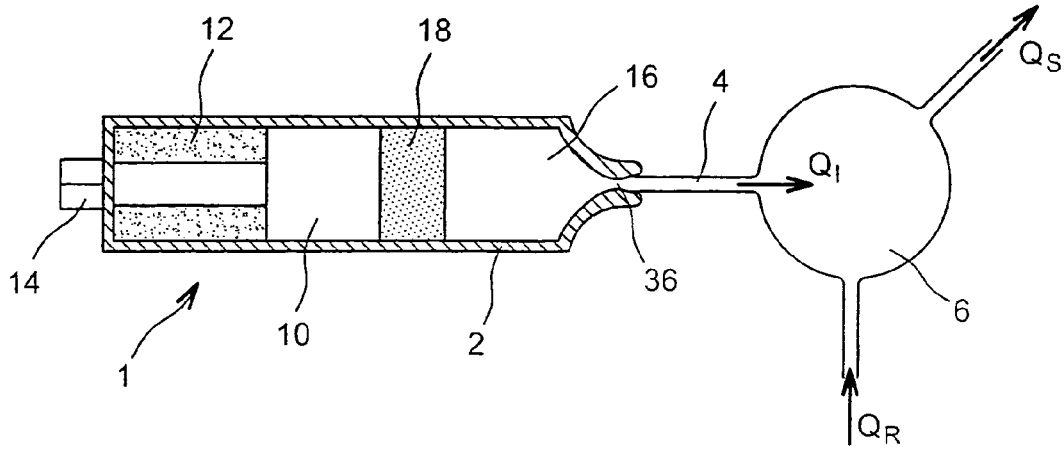
FIG. 3 shows another embodiment of the extinguisher according to the invention.

From what is known for example from the propulsion of rockets, it is indeed possible, by judiciously choosing the nature of the propellant and the geometry of the block, to obtain a controlled flow rate of generated gas, and therefore a regulated pressure in the enclosure 10. In this case, even if a control valve 20 may be provided for, it is possible only to have between the combustion chamber 10 and the distribution means 4 a simple sealing device such as a tared disc, or even to connect directly the outlet port 16 to the distribution means 4. An embodiment of such an extinction device is shown in FIG. 3.

Advantageously, the outlet port 16 is equipped with a nozzle 36, tailored if possible in such a way that the speed of sound is reached at the minimum cross section of the nozzle 36. This makes it possible to isolate the gas generator 2 from the distribution means 4; the pressure fluctuations in the distribution pipe 4 therefore do no perturb the combustion of the pyrotechnic material 12, which allows a better control of the parameters.

In particular, it is possible to calibrate the block of combustible material 12 in such a way as to obtain a flow rate of gas exiting the enclosure 10 via the opening 16 equal to a determined value. The means of regulating the pressure, and thus the flow rate of inert agent into the fire zone 6, are then directly integrated with the gas generator 2: a simple control on the ignition device 14, enables this previously fixed flow rate to be assured.

Indeed, mathematical formula allow the different parameters (pressure, combustion velocity and surface area, flow rate of generated gas, etc.) to be interlinked in order to optimise the geometry of a block of combustible material, of its combustion enclosure, and the initial conditions for a given pyrotechnic material in order to arrive at the desired inert gas flow rate. Thus, the flow of gas brought about by the combustion of a pyrotechnic material 12 such as the propellant is:

$$Q=\rho S_c V_c, \tag{1}$$

where:

Q: flow rate (kg/s);

ρ: volume weight of the propellant (kg/m$^3$);

$S_c$: combustion surface area of the propellant (m$^2$);

$V_c$: velocity of combustion of the propellant (m/s).

It should be noted that the surface area $S_c$ depends on the shape of the block; in particular, it may change during the combustion.

Furthermore, the velocity of combustion of the propellant $V_c$ depends on the pressure prevailing in the combustion chamber, i.e.:

$$V_C=a\cdot P^n, \tag{2}$$

where:

a,n: coefficients depending on the composition of the propellant and determined experimentally;

P: stagnation pressure (Pa) prevailing in the combustion chamber 10.

Finally, the flow of gas going through a nozzle is expressed by:

$$Q = \frac{PA_t}{C_{et}} \cdot C_d, \text{ where} \quad (3)$$

P: stagnation pressure (Pa);

$A_t$: surface area of the nozzle 36 at its neck ($m^2$)

$1/C_{et}$: flow rate coefficient (s/m), depending on the nature of the generated gas;

$C_d$: coefficient inherent in the type of nozzle.

It suffices to resolve these equations as a function of the intrinsic characteristics of the chosen propellant (ρ, a, n, $C_{et}$) and the desired ejection conditions of the gas ($A_t$, P, $V_c$) in order to define the geometry of the gas generator that makes it possible to assure the desired flow rate profile for the required time.

Figure 4:
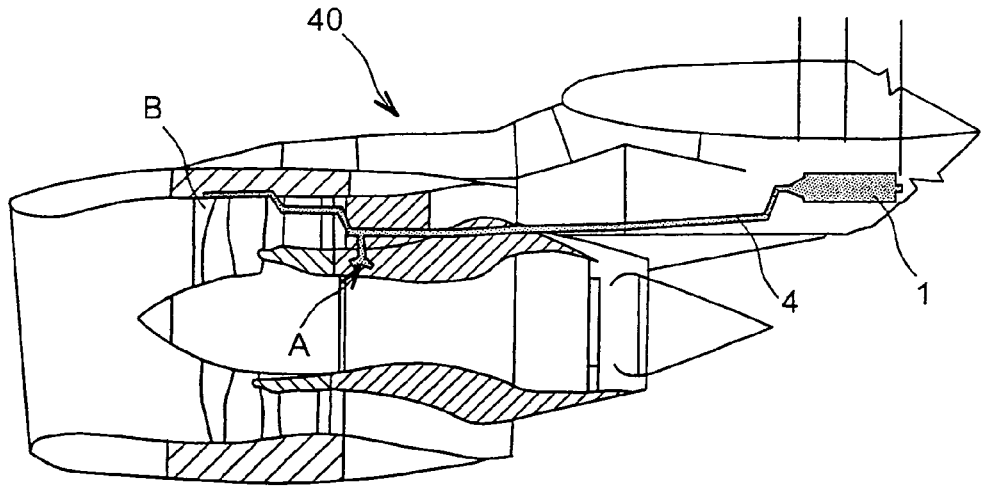
FIG. 4 schematically shows the assembly on board an aircraft of an engine fire extinguishing device according to the invention.

The device according to the invention is particularly advisable for an application in aircraft. FIG. 4 schematically shows the mounting on board a turboshaft engine 40 of an aeroplane of an engine fire extinction device 1 according to the invention, which may be triggered by the detection of fire and/or smoke.

Example

Application of the Invention to the Extinction of Aircraft Engine Fires

The generation of inert gas, preferentially of nitrogen, and at more than 20%, or even 30% or 40%, is obtained by the combustion of a "highly nitrogenated" pyrotechnic composition. The principal characteristics to consider for the choice of a pyrotechnic composition are the efficiency in terms of gas production, the density of the material, the temperature of combustion and the secondary species generated by the combustion. The toxic or/and corrosive aspect of the fumes must also be taken into account, which means certain compositions may be automatically eliminated. In particular, a composition recommended in the case of aircraft concerns a mixture of sodium azide and copper oxide ($NaN_3$/CuO) that gives, through combustion, 40.1% nitrogen. Another possibility concerns guanidine nitrate combined with strontium nitrate ($GN/Sr(NO_3)_2$), the combustion of which gives 32.5% nitrogen and 20% carbon dioxide. The combination of basic copper nitrate and guanidine nitrate (BCN/GN) to produce a gas containing 24.7% $N_2$ and 16.9% $CO_2$ may also be envisaged.

In order to evaluate the quantity of nitrogen to inject, the level of ventilation and the size of the zone(s) concerned are taken into account. By way of example, one will consider an engine 40 according to FIG. 4 with the two fire zones A and B having the following characteristics:

| | Volume V ($m^3$) | Ventilation $Q_R$ ($m^3$/s) (air renewal flow rate) |
|---|---|---|
| Zone A | 1.416 | 0.212 |
| Zone B | 0.476 | 0.285 |

As described previously, the generator of inert agent consists of a combustion enclosure 10, equipped with a block 12 of pyrotechnic product as detailed above, an ignition device 14 and a filter 18, equipped at one end with a nozzle 36 tailored in such a way that the speed of sound is reached at the minimum cross section of the nozzle.

One desires that the placing under an inert atmosphere of the fire zones 6 lasts for 5 seconds. Other configurations of the length of time are often preferred, or even imposed by regulations and, particularly in this case, one desires:

- an extinction phase E ("booster" phase): reduction in the level of oxygen from 21% (nominal concentration of oxygen in the air by volume) to 11% in 1.5 s.
- a maintenance phase M ("inerting" or "sustainer" phase): maintaining the concentration in oxygen at 11% for 3.5 s.

One may therefore note that during the maintenance phase M, the flow rate of nitrogen (or inert gas) is lower than during the extinction phase E. This two-phase regime may be obtained in various ways, such as the use of different pyrotechnic compositions. Preferably, and as is described hereafter, the evolution of the combustion profile of the block of propellant (geometric evolution of the surface area during combustion) makes it possible to obtain such a regime.

The evolution over time of the concentration in oxygen C(t) in a fire zone 6 as schematically shown in FIG. 3 as a function of the flow rate of fresh air (renewal of air in the zone) $Q_R$, of the flow rate stemming from the gas generator injected in the fire zone $Q_I$ (said two flows being evacuated from the fire zone 6 by the flow rate $Q_s=Q_R+Q_I$), and the relative concentrations in oxygen $C_R$ and $C_I$ of these two input flow rates may be expressed by the differential equation:

$$\text{Thus: } C_E(t) = C_R\left(1 - \frac{Q_R}{Q_S}\right) \cdot \exp\left(-\frac{Q_S t}{V}\right) + \frac{Q_R C_R}{Q_S}.$$

which gives (by definition, the flow from the generator does not contain oxygen and $C_I=0$):

$$C(t) = k \cdot \exp\left(-\left(\frac{Q_R + Q_I}{V}\right)t\right) + \frac{Q_I C_I + Q_R C_R}{Q_R + Q_I}$$
$$= k \cdot \exp\left(-\frac{Q_S t}{V}\right) + \frac{Q_R C_R}{Q_S}$$

In the extinction phase E, one desires that over a well defined time period (in the example 1.5 s), one has reached a concentration of 11% (by volume) of oxygen. However, $C_R=0.21$, and when t=0, $C(t)=C_R$, and hence $k=C_R\cdot(Q_S-Q_R)/Q_S$.

$$C(t + dt) = C(t) + \frac{C_R Q_R + C_I Q_I}{V} dt - C(t) \cdot \frac{Q_S}{V} dt \quad (4)$$

In the maintenance phase M, one desires that over a well defined time period (in the example 3.5 s), one maintains the concentration in oxygen at a level very close to that attained at the end of the booster phase and less than the minimum level necessary for combustion. In the same way, $C_R=0.21$, and at any moment, $C_M(t)=C_{min}=0.11$, and hence $k=C_{min}-(Q_R\cdot C_R)/Q_S$.

One therefore obtains directly the quantity of inert gas to be injected during this phase: $Q_{IM}=(Q_R/C_{min})\cdot(C_R-C_{min})$ When all of the calculations have been done, one obtains the following values for the volume flow rate of inert gas to inject in the fire zones:

| Regime | Time (s) | $Q_I$ ($m^3$/s) Zone A | $Q_I$ ($m^3$/s) Zone B | Total ($m^3$/s) | $V_{total}$ ($m^3$) |
|---|---|---|---|---|---|
| Booster E | 1.5 | 0.7 | 0.35 | 1.05 | 1.58 |
| Maintenance M | 3.5 | 0.192 | 0.259 | 0.45 | 1.58 |
| | | | | | 3.16 |

Figure 5A:
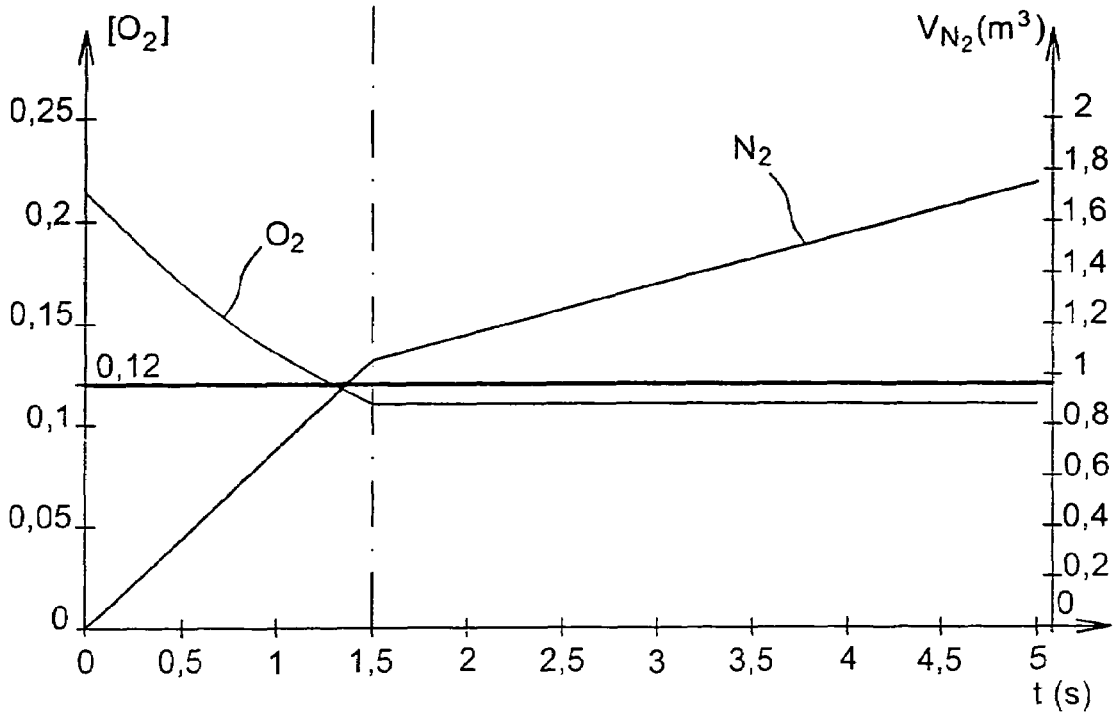
FIG. 5 represent curves showing the evolution of the concentration in oxygen in two fire zones equipped with an extinction device according to the invention.
Figure 5B:
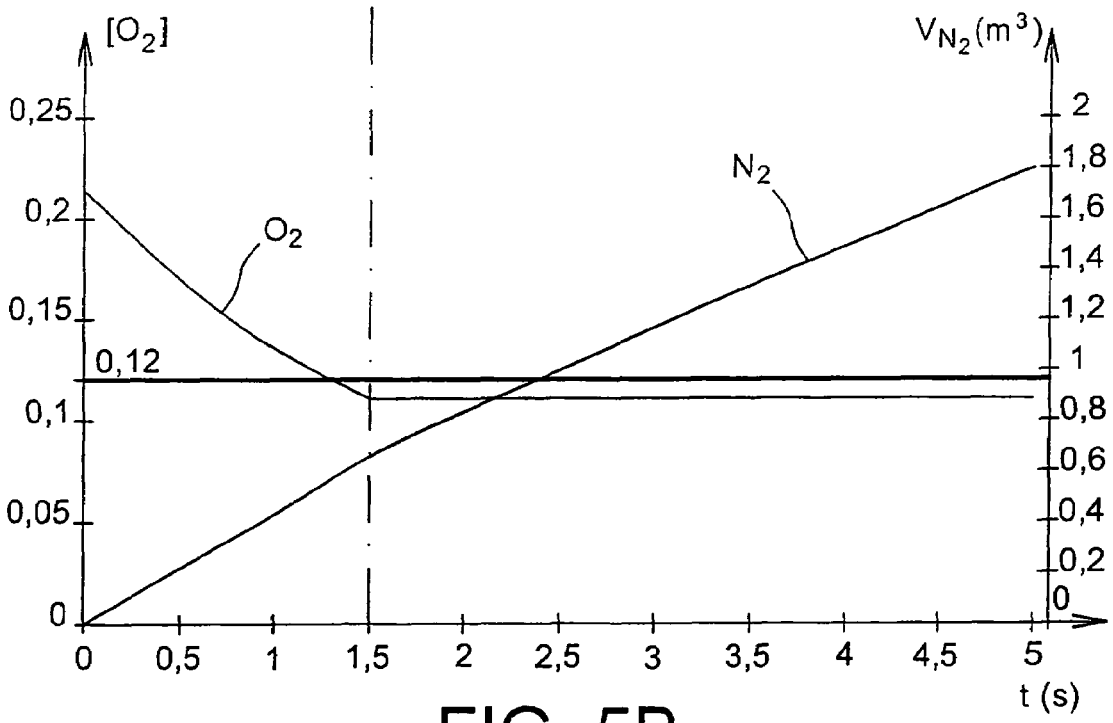

The evolution of the concentration in oxygen at one point for said two fire zones is shown in FIG. 5A for zone A and FIG. 5B for zone B, where the horizontal line represents the level of concentration in oxygen needing to be obtained to secure the fire zone considered, i.e. 12%.

It is clear that it would also be possible with an extinction device according to the invention to manage the flow rate of inert agent in such a way as to have a concentration in oxygen in the fire zone that changes according to a given profile, for example in slots.

Numerous pyrotechnic compositions exist, the combustion of which generates a large quantity of inert gas composed principally of nitrogen and/or carbon dioxide and/or carbon monoxide, in the example given 3.16 $m^3$, while very considerably restricting the production of undesirable additional compounds (see for example above). Those skilled in the art, specialists in propellants, will be able to make the most appropriate choice or to define new compositions as a function of the targeted application.

For the example dealt with here, the dimensioning calculations have been carried out with a propellant, chosen uniquely by way of illustration and in nowise limitative, the ballistic characteristics of which are as follows:

$C_{et}$=1034 m/s $\rho$=1600 Kg/$m^3$ $a=1.7\cdot10^{-6}$ n=0.5 gas yield of gas generated by the mass burned at the combustion temperature: 1.2 l/g.

Moreover, the difference in flow rate between the two phases E and M is in a ratio of 20; however, the outlet port 16 (calibrated nozzle 36) of the combustion chamber 10 is identical in both cases. The operating pressure P of the gas generator 10 will therefore also change in a ratio of 20.

In other words, in order to avoid a too high pressure drop in the combustion chamber during the maintenance phase M, which would be detrimental to the ejection conditions, one may set an operating pressure for this phase, for example 5 bars ($5\cdot10^5$ Pa). For the extinction phase E, the pressure then reaches 100 bars ($100\cdot10^5$ Pa).

The volume flow rate that one desires for the booster phase E is $Q_I$=1.05 $m^3$/s=1050 l/s, i.e. a mass flow rate of gas exiting the generator of 875 g/s. The velocity of combustion of the propellant at 100 bar is $V_{cE}=a\cdot P^n=1.7\cdot10^{-6}\cdot(100\cdot10^5)^{0.5}=5.4\cdot10-3$ m/s.

The thickness of propellant to burn during this booster phase E of 1.5 s is therefore $Ep_E$=8.1 mm. The combustion surface area $S_c$ is deduced from the equation (1), i.e. $S_{cE}$=0.1 $m^2$.

The dimensioning of the nozzle uses the equation (3), i.e. $A_t=(Q_{Im}\cdot C_{et})/P\cdot C_d)$, where $C_d$=0.99, i.e. a passage surface area at the neck $A_t=91.4\times10^6$ $m^2$, or a diameter d=10.8 mm.

For the maintenance phase M, the desired volume flow rate is 0.05 $m^3$/s i.e. 50 l/s, which gives a mass flow rate of gas exiting the generator $Q_{Im}$=42 g/s for a pressure 5 bars. The rate of combustion is $Vc_M=a\cdot P^n=1.2\times10^{-3}$ m/s, and the thickness of propellant to burn during this phase of 3.5 s is $Ep_M$=4.2 mm, i.e. a combustion surface area $S_{cM}$=0.022 $m^2$.

The surface areas during combustion, which are different during the booster phase E and maintenance phase M (by a ratio of 4.55), may be obtained in several ways, with blocks burning on a single face "like a cigarette", on several faces, etc. The shape to give to the block depends on the manufacturing conditions, the change of surface, but also the method of ignition. It is possible to optimise the evolution of the combustion surface area over time in order to obtain a desired flow rate law.

As specified above, it is also possible to provide for two different types of propellants, for the two phases of combustion.

The above description does not exclude all the alternatives that those skilled in the art will not fail to notice to make a device according to the invention. In particular, various combinations are possible between the different embodiments described. It is clear, for example, that it is conceivable not to have a control unit 24, but instead separate sensors and controls for each device to be controlled. In the same way, for a device 1 comprising several gas generators 2, one may envisage that certain generators are designed in such a way as to have a regulated production of gas, whereas others, connected to the same distribution means, have a generation of gas regulated by valves 20. Moreover, depending on the desired profiles, it is possible to have more than two different compositions in a block of propellant 12.

The invention claimed is:

1. An extinction device, comprising:

a gas generator comprising an enclosure equipped with a gas outlet port and a block of pyrotechnic material that generates propellant gas, wherein the propellant gas generated from the block of pyrotechnic material is the only gas generated by the extinction device as an extinguishing gas;

a filter positioned downstream from the pyrotechnic material within the enclosure and configured to cool the propellant gas;

means for distributing said propellant gas coupled to the gas outlet port; and means for regulating pressure created by said propellant gas in the distribution means, wherein the block of pyrotechnic material includes a propellant configured to be ignited by an ignition device such that the propellant gas is generated from the block of pyrotechnic material by ignition, and wherein the gas generator is configured to have a booster phase, during which the propellant gas has a volume flow rate of 1.05 $m^3$/s, and a maintenance phase, during which the propellant gas has a volume flow rate of 0.05 $m^3$/s.

2. The device according to claim 1, further comprising at least one control valve in the distribution means.

3. The device according to claim 2, further comprising first control means for controlling the control valve as a function of control parameters.

4. The device according to claim 3, wherein the first control means comprise means for measuring a concentration of oxygen in a zone to be treated and said concentration is one of the control parameters.

5. The device according to claim 4, further comprising at least one control unit connected to the first control means.

6. The device according to claim 5, further comprising at least one combustion trigger device of the block of pyrotechnic material and second control means for setting off the combustion trigger device connected to the control unit.

7. The device according to claim 6, wherein the second control means comprise means for detecting a fire and/or manual triggering means, and detection by the means for detecting and manual triggering by the manual triggering means are control parameters of the combustion trigger device.

8. The device according to claim 7, wherein the second control means comprise neutralisation means.

9. The device according to claim 1, further comprising a plurality of gas generators each comprising an enclosure equipped with a gas outlet port, a block of pyrotechnic material that generates propellant gas and connection means for coupling each gas outlet port to the distribution means.

10. The device according to claim 9, further comprising at least one control valve in the connection means.

11. The device according to claim 10, further comprising a control valve in the distribution means.

12. The device according to claim 11, further comprising control means capable of controlling each of the control valves.

13. The device according to claim 1, further comprising at least one combustion trigger device for the block of pyrotechnic material.

14. The device according to claim 13, further comprising second control means for setting off the combustion trigger device.

15. The device according to claim 14, wherein the second control means comprise means for detecting a fire and/or manual triggering means, and manual triggering by the manual triggering means and detection by the means for detecting are control parameters of the trigger device.

16. The device according to claim 14, wherein the second control means comprise neutralisation means.

17. The device according to claim 1, wherein the regulation means are an integral part of at least one first gas generator and the following parameters of the first generator are selected so that a flow rate law of gas stemming from combustion of the block of pyrotechnic material in the distribution means follows a predetermined and controlled profile: stagnation pressure in the enclosure, size of the port, and surface area of the block of pyrotechnic material.

18. The device according to claim 17, further comprising a nozzle at the outlet port of the enclosure of the first gas generator.

19. The device according to claim 18, wherein the nozzle is tailored in such a way that at a minimum cross section of the nozzle, the gases generated by the combustion of pyrotechnic material from the first generator have a speed equal to the speed of sound.

20. The device according to claim 1, wherein the block of pyrotechnic material comprises two materials of different composition.

21. The device according to claim 1, further comprising at least one tared disc at a level of the outlet port.

22. The device according to claim 1, further comprising at least one filter for retaining particles.

23. The device according to claim 1, further comprising means for cooling the propellant gas.

24. A turbojet engine, comprising:

a device according to claim 1.

25. The device according to claim 1, wherein the propellant gas comprises at least twenty percent nitrogen.

26. The device according to claim 1, wherein the device does not contain an extinguishing agent in liquid or gas form until the ignition of the block of pyrotechnic material.

27. An extinction device, comprising:

a gas generator comprising an enclosure equipped with a gas outlet port and a block of pyrotechnic material that generates propellant gas;

a pipe for distributing the generated gas coupled to the gas outlet port; and an ignition device for triggering the combustion of the block of pyrotechnic material, wherein the following parameters of the first generator are selected so that a flow rate law of gas stemming from combustion of the block of pyrotechnic material in the distribution pipe follows a predetermined and controlled profile: stagnation pressure in the enclosure, size of the disc, and surface area of the block of pyrotechnic material, wherein the block of pyrotechnic material includes a propellant configured to be ignited by the ignition device such that the propellant gas is generated from the block of pyrotechnic material by ignition, and wherein the gas generator is configured to have a booster phase, during which the propellant gas has a volume flow rate of 1.05 $m^3/s$, and a maintenance phase, during which the propellant gas has a volume flow rate of 0.05 $m^3/s$.

28. The device according to claim 27, further comprising a tared disc at the level of the outlet port.

29. The device according to claim 27, further comprising a filter for cooling the generated gas.

30. An extinction device, comprising:

a distribution pipe towards a fire zone;

a plurality of gas generators each comprising an enclosure equipped with a gas outlet port;

a block of pyrotechnic material that generates propellant gas;

connection pipes to couple each gas outlet port to the distribution pipe; and means of regulating the pressure created by the gas generated in the distribution means, wherein the block of pyrotechnic material includes a propellant configured to be ignited by an ignition device such that the propellant gas is generated from the block of pyrotechnic material by ignition, and wherein at least one of the gas generators is configured to have a booster phase, during which the propellant gas has a volume flow rate of 1.05 $m^3/s$, and a maintenance phase, during which the propellant gas has a volume flow rate of 0.05 $m^3/s$.

31. The device according to claim 30, further comprising at least one device for triggering combustion of each block of pyrotechnic material, and second control means to set off each combustion trigger device.

* * * * *